US011358853B2

(12) United States Patent
Wells

(10) Patent No.: US 11,358,853 B2
(45) Date of Patent: Jun. 14, 2022

(54) SODA GUN HOLSTER ASSEMBLY

(71) Applicant: Soda Lock LLC, Winterville, GA (US)

(72) Inventor: James Brandon Wells, Winterville, GA (US)

(73) Assignee: SODA LOCK LLC, Winterville, GA (US)

( * ) Notice: Subject to any disclaimer, the term of this patent is extended or adjusted under 35 U.S.C. 154(b) by 0 days.

(21) Appl. No.: 17/295,648

(22) PCT Filed: Jul. 12, 2019

(86) PCT No.: PCT/US2019/041732
§ 371 (c)(1),
(2) Date: May 20, 2021

(87) PCT Pub. No.: WO2021/010950
PCT Pub. Date: Jan. 21, 2021

(65) Prior Publication Data

US 2021/0354973 A1 Nov. 18, 2021

(51) Int. Cl.
*B67D 1/06* (2006.01)
*B67D 1/16* (2006.01)

(52) U.S. Cl.
CPC *B67D 1/06* (2013.01); *B67D 1/16* (2013.01)

(58) Field of Classification Search
CPC ..... B67D 1/06; B67D 1/16; B67D 1/0084; B67D 1/0086; F16M 13/02; F16M 13/00; B25H 3/04
USPC ..... 248/314
See application file for complete search history.

(56) References Cited

U.S. PATENT DOCUMENTS 2,371,433 A * 3/1945 Davis ..... B25H 3/04 211/70.6
5,484,066 A * 1/1996 Luisi ..... B43K 23/002 211/69.8
D481,930 S * 11/2003 Hein ..... A47L 13/512 D8/373
9,010,708 B2 * 4/2015 Vasilev ..... A47K 1/09 248/539
9,546,085 B2 * 1/2017 Baron ..... B67D 1/0042
2008/0217357 A1 * 9/2008 Hecht ..... B67D 1/0084 222/108
2009/0277927 A1 * 11/2009 Schroeder ..... B67D 1/0084 222/108

(Continued)

FOREIGN PATENT DOCUMENTS

WO 2015035471 A1 3/2015

*Primary Examiner* — Andrew D StClair
(74) *Attorney, Agent, or Firm* — Mark C. Johnson; Johnson Dalal

(57) ABSTRACT

A soda gun holster assembly having a holster housing with a mounting bracket operably configured to selectively couple with a countertop and a sidewall that defines a soda gun storage zone where a liquid dispensing gun can be inserted therein from the front of the holster housing. The holster housing includes a flexible U-shaped clip disposed within the soda gun storage zone that is operably configured to receive and retain the soda gun, namely the nozzle portion of the soda gun, therein. The soda gun holster assembly may also include a liquid capturing basin selectively removably coupled to the holster housing for retaining and directing errant and/or dripped liquid from the soda gun to another area.

24 Claims, 9 Drawing Sheets

(56) References Cited

U.S. PATENT DOCUMENTS

| | | | | |
|---|---|---|---|---|
| 2011/0220159 | A1* | 9/2011 | Ellickson | B67D 1/0084 134/198 |
| 2016/0010763 | A1 | 1/2016 | Hecht et al. | |
| 2017/0129760 | A1* | 5/2017 | Aneson | B08B 9/00 |
| 2018/0177329 | A1 | 6/2018 | Segiet et al. | |
| 2018/0251362 | A1 | 9/2018 | Salem | |

* cited by examiner

SODA GUN HOLSTER ASSEMBLY

FIELD OF THE INVENTION

The present invention relates generally to holster assemblies and, more particularly, relates to holster assemblies operably configured to hold and retain a soda or other liquid dispensing gun.

BACKGROUND OF THE INVENTION

Whether it is a busy restaurant or bar or for personal use, many users desire to dispense liquid in a fast and effective manner. Dispensing from a "bar gun" or "soda gun," instead of directly from a container, results in a liquid drink being freshly carbonated at the same temperature and pressure when it will be consumed. In most instances this is done by mixing a syrup with a water at the last possible stage, thereby saving energy and overall costs associated with transporting the syrup. The main benefit for commercial drink establishments is the time it takes to dispense drinks because drinks do not need to be retrieved and they can be poured faster than from a drink housed in a container. The soda gun is a device used by many users to serve various types of carbonated and non-carbonated drinks. A soda gun has the ability to serve any beverage that is some combination of syrup, water, and/or carbon dioxide. This includes soft drinks, iced tea, carbonated water, and plain water. When served from a soda gun, these are often known as fountain drinks.

While dispensing with a soda gun is desired by many users, it does come with some drawbacks. The cost of a soda gun can be relatively expensive, so preventing inadvertent dislodging and damage to the soda gun is desired. In an attempt to solve this problem, some devices utilize an annular shaped socket that protrudes from underneath a countertop and that is lined with a deformably resilient material, such as rubber. In practice, the user will insert the nozzle portion of the soda gun into a socket aperture and the soda gun will be retained by the rubber-lined sidewall of the socket. Problematically, however, the soda gun still prone to being inadvertently hit, dislodged, and/or damaged by users. Further, the soda gun is prone to leaking after use, thereby causing floors to be slippery and posing a safety risk to users. Additionally, those known holsters for a soda gun also do not effectively prevent damage to the soda gun when it is inserted, retained, and/or removed, thereby causing users loss profits and reduced productivity when the soda gun is damaged.

Additionally, liquid dispensing guns are also accessed numerous times a day by many users. Since these dispensing guns are plumbed back to a manifold body via a multi-conductor loomed/sheathed connection, the positioning of the dispenser is limited and somewhat controlled by the flexibility of this connection and weight of this tethered connection. This alone can be responsible for unintentionally removing the dispenser from a holstered position since the combination results in the bar gun resting at odd angles and can literally pry the bar gun loose from its retaining grommet. Also, normal use of dispensing gun will invariably foul the rubber-lined sidewall with fluid residue, producing a slippery and less reliable surface for gripping the nozzle end. The resulting effect from either will cause the dispenser to fall free from the holster and either become damaged from impact of surrounding equipment and/or the floor or biologically contaminated from contact with surfaces. Therefore, a need exists to overcome the problems with the prior art as discussed above.

SUMMARY OF THE INVENTION

The invention provides a soda gun holster assembly that overcomes the hereinafore-mentioned disadvantages of the heretofore-known devices and methods of this general type and that safely, effectively, and efficiently retains and houses a soda gun.

With the foregoing and other objects in view, there is provided, in accordance with the invention, a soda gun holster assembly that includes a holster mounting bracket with an upper face and a lower face opposing the upper face of the mounting bracket and a holster housing coupled to the lower face of the holster mounting bracket. The holster housing has a sidewall surrounding and defining a soda gun storage zone and at least two opposing side terminal ends defining a first end of the holster housing and a housing opening spatially coupled to the soda gun storage zone, wherein the first end of the holster housing opposes a second end of the holster housing and the holster housing defines a housing length separating the first and second ends of the holster housing. The soda gun holster assembly also includes an upper end and a lower end, the holster housing defining a nozzle translation channel disposed along the housing length and at the lower end of the holster housing and a flexible U-shaped clip coupled to the sidewall and having a continuous sidewall with at least two opposing terminal ends defining a single clip opening spatially coupled to the nozzle translation channel and a nozzle receiving channel defined by an inner surface of the continuous sidewall. The U-shaped clip has two opposing portions thereon with a rounded outer surface separating and defining a clip entrance width less than a diameter of the nozzle receiving channel, wherein the two opposing portions interpose the nozzle receiving channel and the at least two opposing terminal ends of the flexible U-shaped clip.

In accordance with a further feature of the present invention, the upper face of the holster mounting bracket is substantially planar and the holster mounting bracket is selectively removably couplable to the holster housing with at least one fastener.

In accordance with another feature of the present invention, the nozzle receiving channel is disposed proximal to the second end of the holster housing and is of an annular shape.

In accordance with another feature, an embodiment of the present invention includes a lower guide member disposed proximal and coupled to the first end of the holster housing, wherein the lower guide member has an upper concave surface at least partially facing the nozzle translation channel. In one embodiment, the upper concave surface of the lower guide member is disposed in an upwardly sloped configuration toward the first end of the holster housing.

In accordance with an additional feature, an embodiment of the present invention also includes an upper guide member disposed proximal and coupled to the lower face of the mounting bracket, wherein the upper guide member has a side guide member and a top guide member both partially defining the soda gun storage zone. The top guide member may be of a plurality of cascading wall portions extending downwardly away from the lower face of the mounting bracket and into the soda gun storage zone and in a direction toward the flexible U-shaped clip.

In accordance with an additional feature, an embodiment of the present invention also includes a liquid capturing basin having a sidewall with an upper edge directly coupled to the lower end of the holster housing, a bottom wall coupled to the sidewall of the liquid capturing basin, and a spout with a spout opening, wherein the sidewall of the liquid capturing basin surrounds and defines, with the bottom wall of the liquid capturing basin, a liquid capturing cavity.

In accordance with a further feature of the present invention, the nozzle receiving channel of the U-shaped clip is disposed in an overlapping configuration with respect to the spout opening.

In accordance with yet another feature, an embodiment of the present invention also includes the liquid capturing basin having a first end and a second end opposing the first end of the liquid capturing basin, wherein the spout opening is disposed proximal to the second end of the liquid capturing basin and the bottom wall of the liquid capturing basin is disposed in a downwardly sloped configuration in a direction away from the first end of the liquid capturing basin and toward the first end of the liquid capturing basin.

In accordance with an additional feature, an embodiment of the present invention also includes the liquid capturing basin having at least two flexible locking tab members each coupled to the liquid capturing basin and extending outwardly away from and passed the upper edge of the sidewall of the liquid capturing basin, the liquid capturing basin selectively removably coupled to the holster housing through the least two flexible locking tab members.

Although the invention is illustrated and described herein as embodied in a soda gun holster assembly, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the housing spanning from the first end to the second end of the housing.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
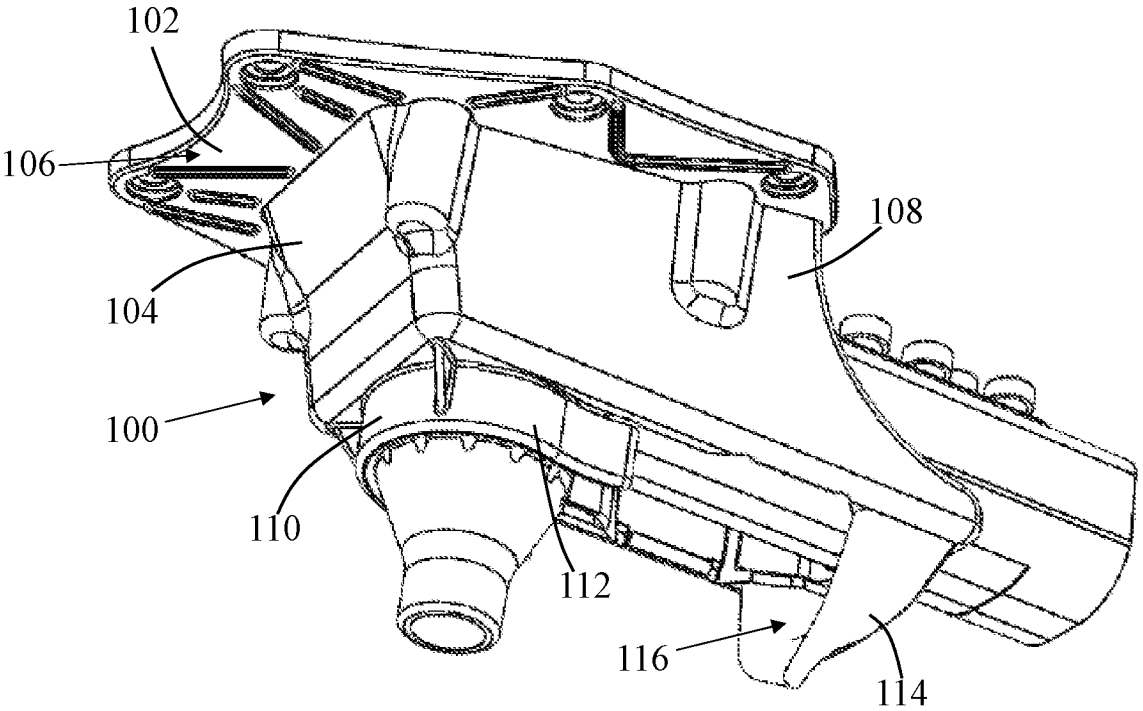
FIG. 1 is a perspective view of a soda gun holster assembly in accordance with one embodiment of the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient soda gun holster assembly that effectively, safely, and efficiently retains a soda gun in an orientation desired by many users. Embodiments of the invention provide a part of the soda gun holster assembly that effectively and efficiently retains and directs errant, dripped, or other liquid from the soda gun to an area where it can be evacuated to an open drain system and/or serviced by when desired by the users.

Figure 3:
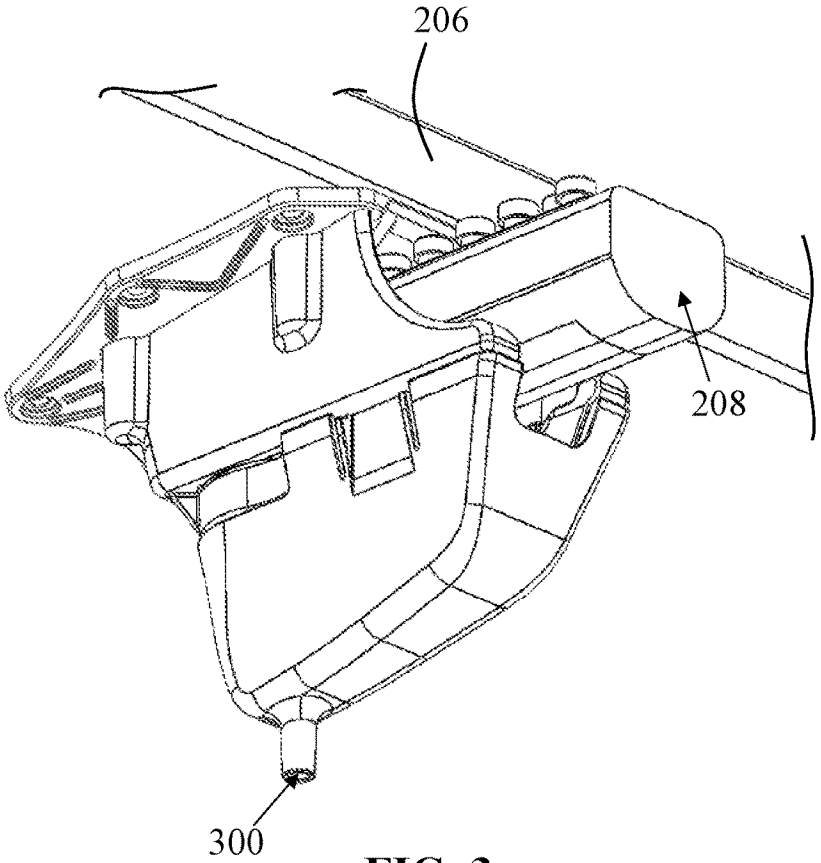
FIGS. 2-3 are perspective views of the soda gun holster assembly coupled to the underside of a countertop in accordance with one embodiment of the present invention.
Figure 2:
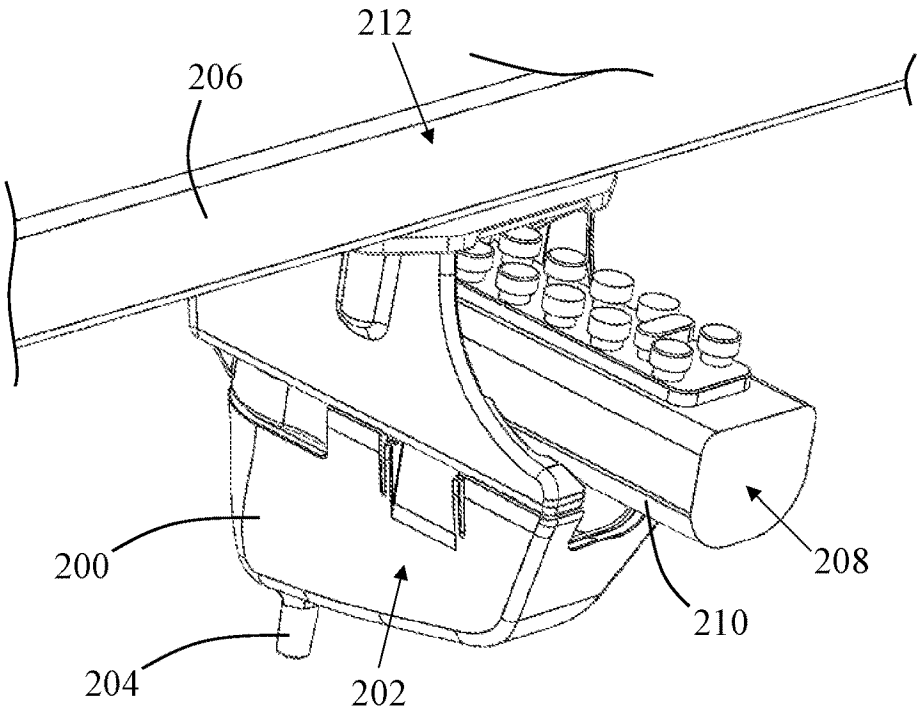

Referring now to FIGS. 1-3, embodiments of the present invention are shown in perspective views. FIGS. 1-3, along with the other figures depicted herein, show several advantageous features of the present invention, but, as will be described below, the invention can be provided in several shapes, sizes, combinations of features and components, and varying numbers and functions of the components. The first example of a soda gun holster 100 assembly, as shown in FIGS. 1-3, includes a holster mounting bracket 102 and a holster housing 104. The holster mounting bracket 102 effectuates placement and attachment of the assembly 100 to a countertop 206, namely the underside of a countertop 206, wherein the holster housing 104, namely the U-shaped clip 110 of the holster housing 104, effectuates safe, effective, and efficient retention and removal of a soda gun 208. In other embodiments of the present invention, the bracket 102 will enable the soda gun 208 to be orientated in a substantially perpendicular orientation with respect to the upper surface of the countertop. The assembly 100 can also beneficially be seen having a liquid capturing basin 200 that is operably configured to house and/or direct liquid inadvertently emitted from the soda gun 208.

While the term "soda gun" is used for conveying the principal application of the assembly 100, those of skill in the art will appreciate that any type of liquid may be dispensed therefrom and the soda gun 208 may take other shapes or forms that still enable the assembly 100 to be effectively, safely, and efficiently used therewith.

Figure 5:
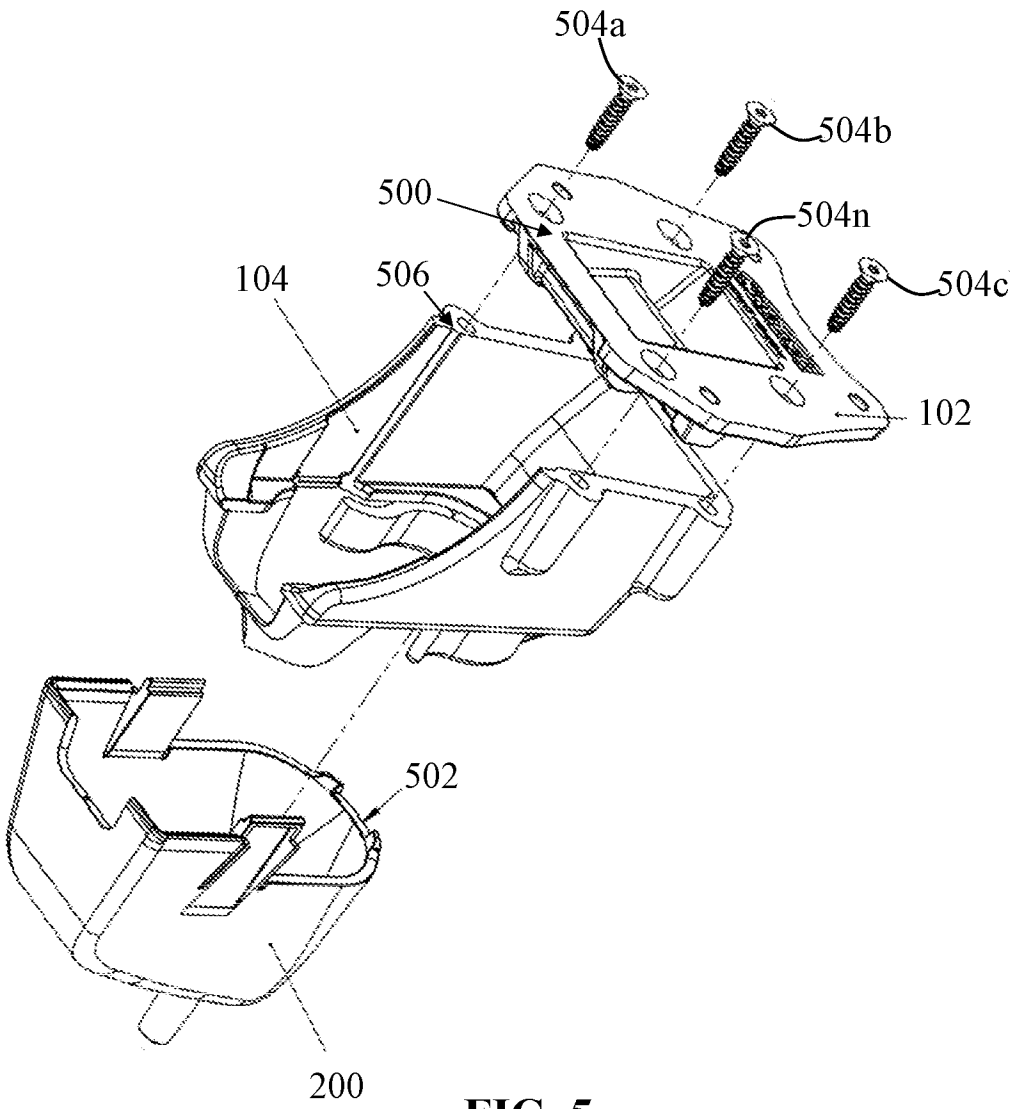
FIG. 5 is an exploded view of the soda gun holster assembly in accordance with one embodiment of the present invention.
Figure 7:
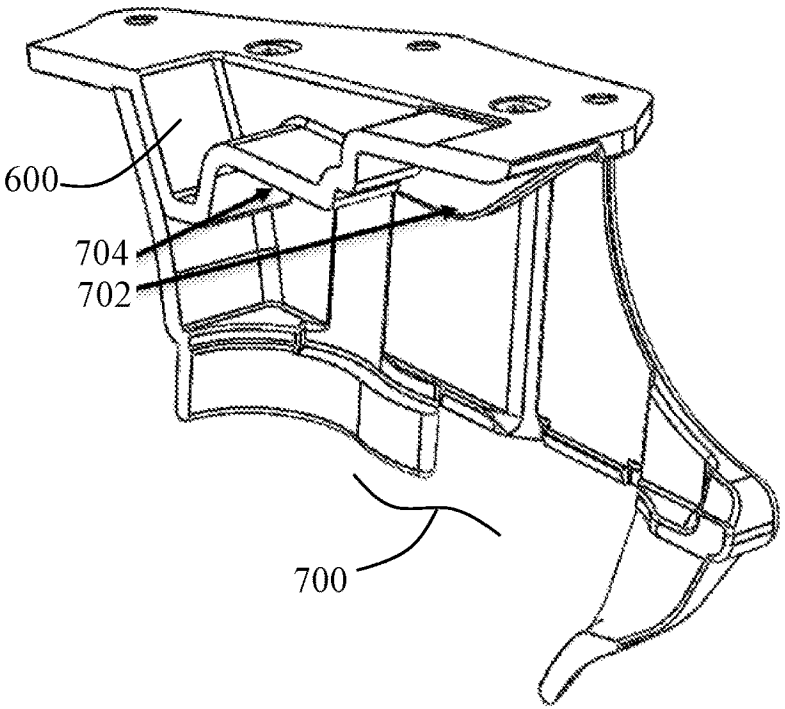
FIG. 7 is a cross-sectional view of a holster mounting bracket and a holster housing of the soda gun holster assembly in accordance with one embodiment of the present invention.
Figure 6:
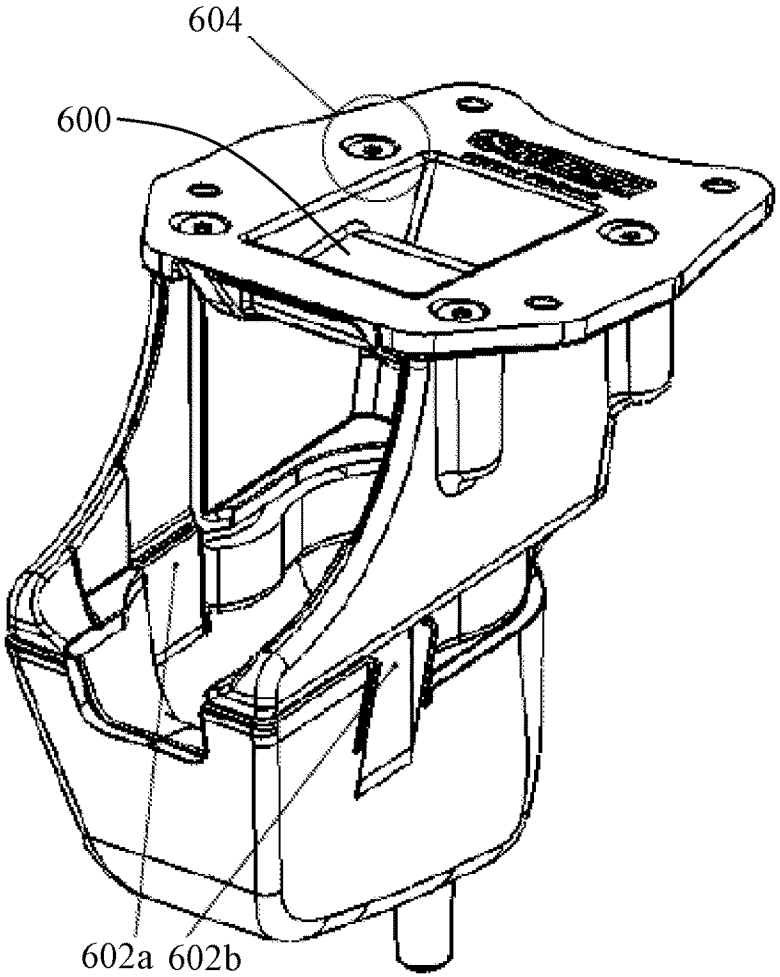
FIG. 6 is a perspective view of a soda gun holster assembly assembled together in accordance with one embodiment of the present invention.
Figure 9:
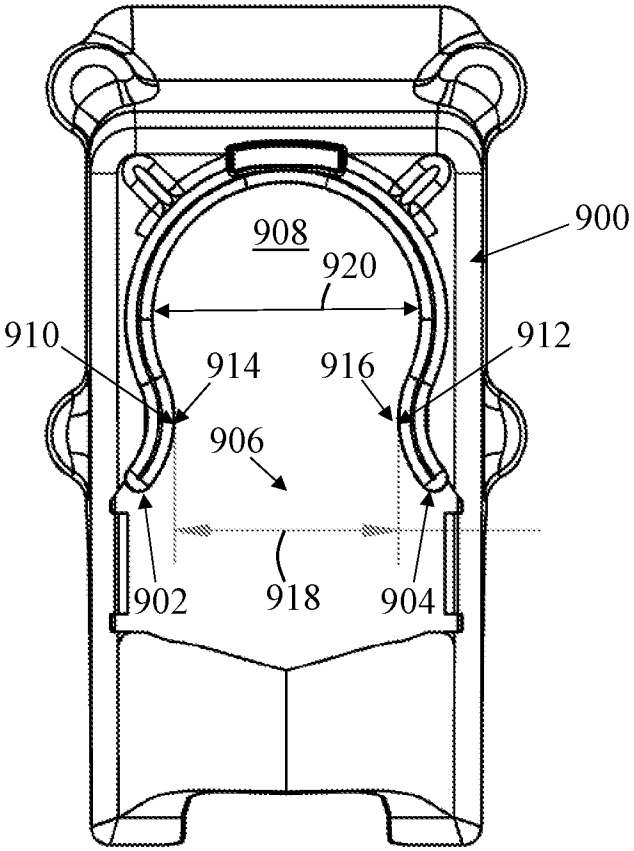
FIG. 9 is a bottom plan view of the holster housing in FIG. 8.
Figure 8:
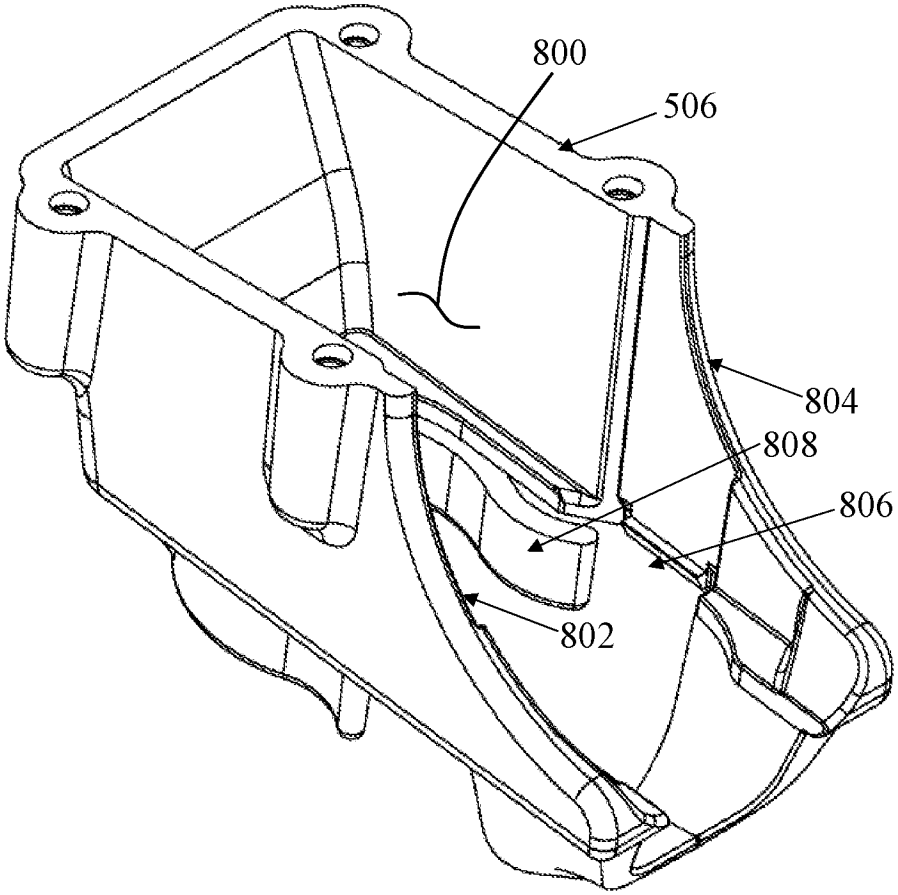
FIG. 8 is a perspective view of the holster housing of the soda gun holster assembly in accordance with one embodiment of the present invention.
Figure 11:
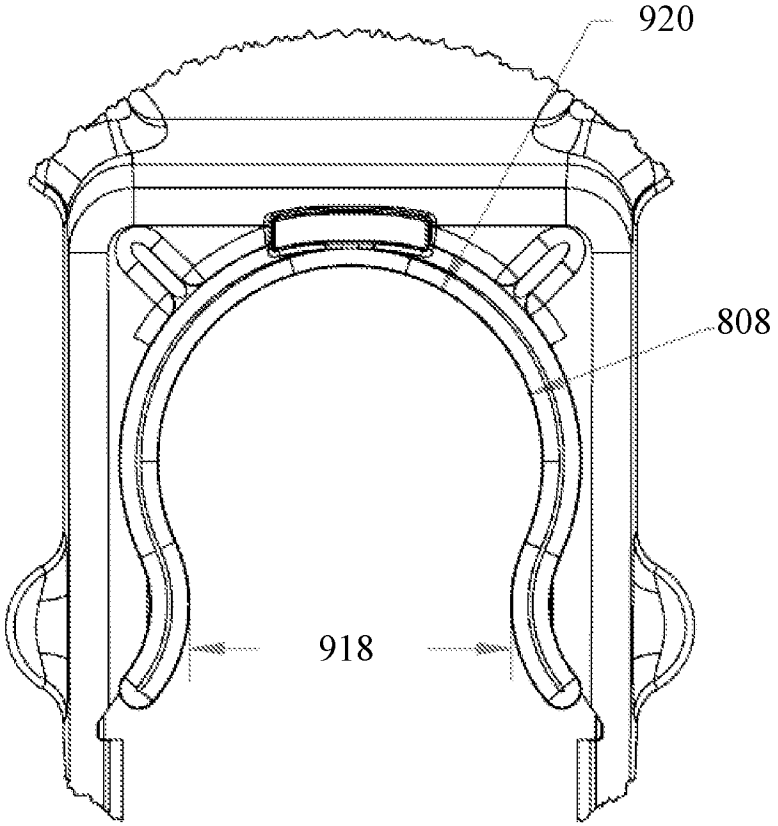
FIG. 11 is a close-up view of the U-shaped clip on the holster housing in FIG. 8.
Figure 10:
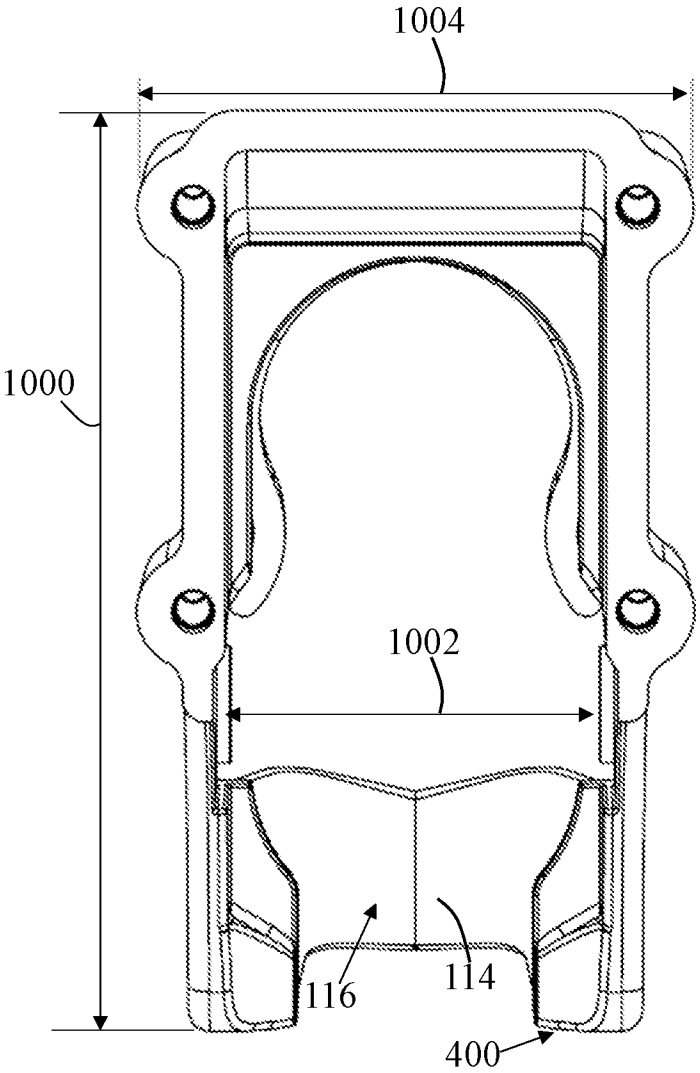
FIG. 10 is a top plan view of the holster housing in FIG. 8.
Figure 13:
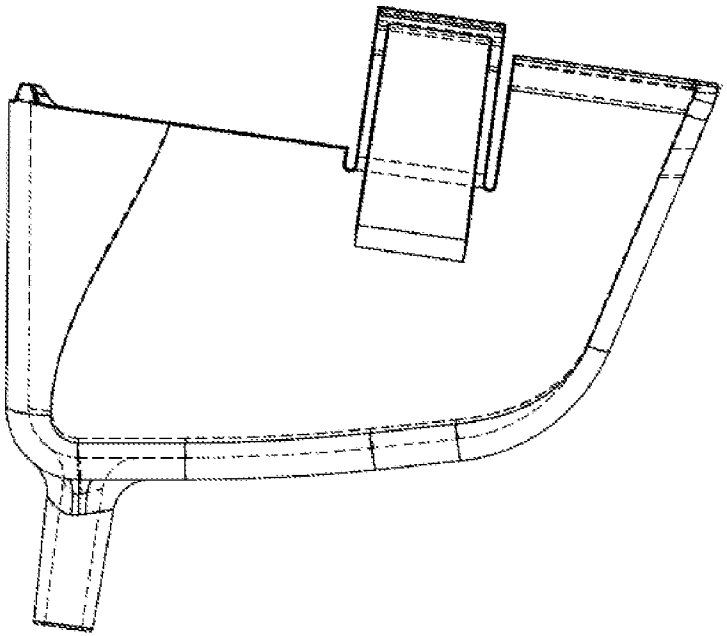
FIG. 13 is a cross-sectional view of the liquid capturing basin in FIG. 12.
Figure 12:
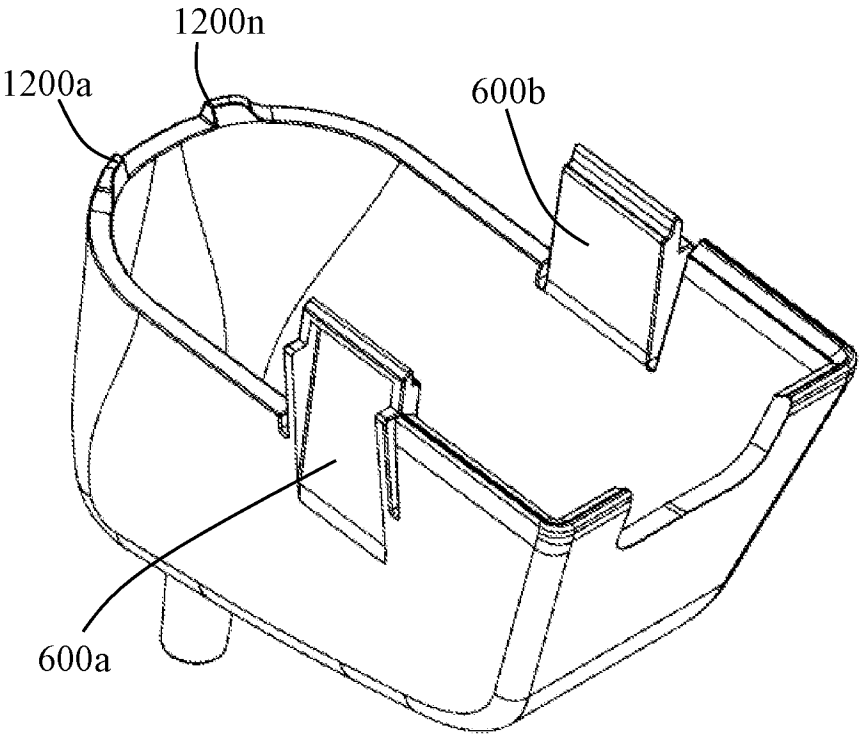
FIG. 12 is a perspective view of a liquid capturing basin of the soda gun holster assembly in accordance with one embodiment of the present invention.
Figure 14:
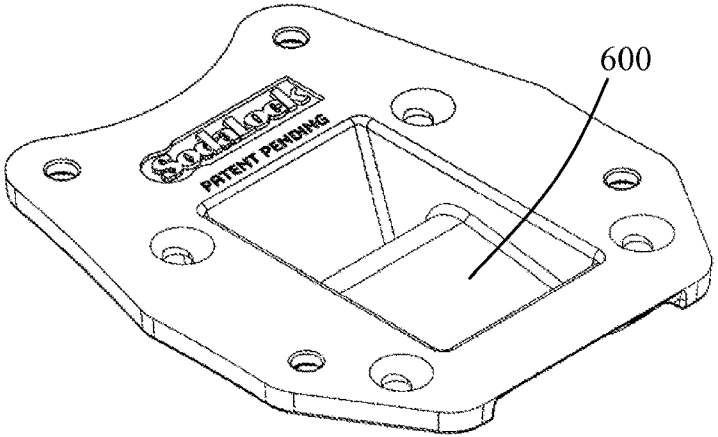
FIG. 14 is a perspective view of a holster mounting bracket of the soda gun holster assembly in accordance with one embodiment of the present invention.
Figure 15:
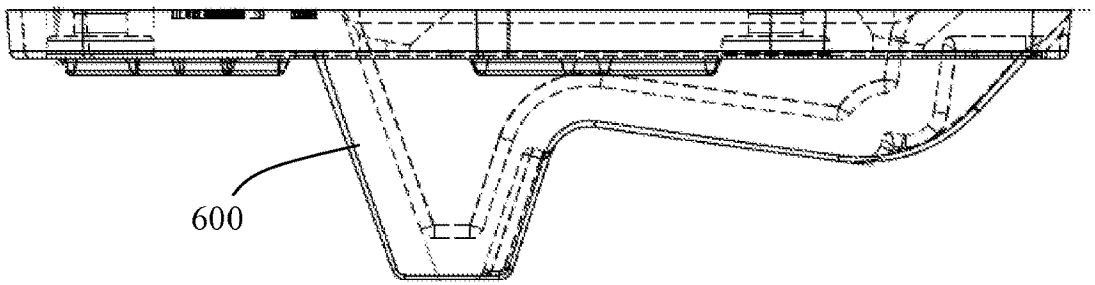
FIG. 15 is a cross-sectional view of the holster mounting bracket in FIG. 14.

In one embodiment, the bracket 102 and holster housing 104 may be formed of a single piece of substantially rigid material, such as 13% glass-filled PA66 Nylon or polypropylene with a hardness of approximately 30-60 Shore D. In other embodiments, the bracket 102 and holster housing 104 may be formed separately and directly coupled to together using one or more fasteners 500*a-n*, wherein "n" represents any number greater than one. As seen best in FIGS. 5-6, each of areas where the head of each of the fasteners 500*a-n* is attached to the bracket 102, e.g., area 604, is countersunk so that the upper face 500 of the mounting bracket 102 can couple with the underside of the countertop 206 in a flush configuration. Said another way, the area 604 is of a shape and size to receive the head of each of the fasteners 500*a-n* so that it is disposed within bracket 102 and lower than the upper face 500. Preferably, the bracket 102 will utilized four fasteners 500*a-n* to retain the bracket 102 to an upper end 506 of the holster housing 104. Additionally, the upper face 500 of the holster mounting bracket 102 may also be substantially planar to effectively attach the bracket 102 to the countertop 206 in a flush configuration.

Still referring to FIGS. 1-3 in connection with FIGS. 4-9, the holster mounting bracket 102 also includes a lower face 106 opposing the upper face 500 of the mounting bracket 102. The holster housing 104 may be coupled to the lower face 106 of the holster mounting bracket 102 and includes a sidewall 108 surrounding and defining a soda gun storage zone 800 where the soda gun 208 is placed and housed when not in use. The lower face 106 of the holster mounting bracket 102 may also define the soda gun storage zone 700. As used herein, the term "wall" is intended broadly to encompass continuous structures, as well as, separate structures that are coupled together to form a substantially continuous external surface.

To permit quick and effective removal and storage of the soda gun 208, in addition to repeated proper positioning and orientation of the soda gun 208, the sidewall 108 of the holster housing 104 has at least two opposing side terminal ends 802, 804 defining a first end 400 of the holster housing 104 and a housing opening 806 spatially coupled to the soda gun storage zone 700. The first end 400 of the holster housing 104 opposes a second end 402 of the holster housing 104 and the holster housing defines a housing length 1000 separating the first and second ends 400, 402 of the holster housing 104. In one embodiment, the housing opening 806 is approximately 2-3 inches spanning from the two opposing side terminal ends 802, 804 and the housing length is approximately 4-5 inches. The height of the housing 104 spanning from a lower end 900 of the housing 104 to the upper end 506 of the housing may be approximately 3-4 inches. Other dimensional magnitudes, however, are contemplated based on the design application of the assembly 100.

The holster housing 104 also defines a nozzle translation channel 700 disposed along the housing length 1000 and at the lower end 900 of the holster housing 104. The nozzle translation channel 700 provides an opening where the nozzle end 412 of the soda gun 208 and move linearly back-and-forth within the housing 104 without damaging the soda gun 208. The width 1002 of the nozzle translation channel 700 and the width 1004 of the holster housing 104 may be approximately 1-2 inches. Said another way, the nozzle translation channel 700 also provides a channel for moving the soda gun 208 to and from the flexible U-shaped clip 110 for attachment thereto. Said another way, the internal sidewall configuration and channel 700 of the holster housing 104 effectively guides the sides of the soda gun 208 to the U-shaped clip 110 with minimizing the contact of the nozzle with any surface or structure (thereby reducing the likelihood of damaging the nozzle).

The flexible U-shaped clip 110 may be coupled to the sidewall 108 and preferably has a continuous sidewall 112 with at least two opposing terminal ends 902, 904 unattached from the holster housing 104 and defining a single clip opening 906 spatially coupled to the nozzle translation channel 700 and a nozzle receiving channel 908 defined by an inner surface 808 of the continuous sidewall 112. As best seen in FIGS. 1-2, FIG. 4, and FIG. 9, the U-shaped clip 110 is operably configured to flex laterally to receive the soda gun 208, namely the nozzle end 412, within the nozzle receiving channel 908 of the U-shaped clip 110 when the user pushes the soda gun 208 within the opening 906. Then, after user releases the soda gun 208, the U-shaped clip 110 is operably configured compressively retain the soda gun 208 in an orientation with the nozzle opening 414 facing downwardly away from the lower face 106 of the mounting bracket 102 and the handle 210 of the soda gun 208 projecting outwardly away from the edge of the countertop 206 in a substantially parallel orientation with a top surface 212 of the countertop 206. Said another way, before the soda gun 208 is inserted in the U-shaped clip 110, the U-shaped clip 110 is in a static configuration and, when the soda gun 208 is inserted in the U-shaped clip 110, the U-shaped clip 110 is in a dynamic configuration with the inner surface 808 of the U-shaped clip 110 compressively retaining the soda gun 208 without the use of any ancillary fasteners.

To facilitate in the attachment of the U-shaped clip 110 with the soda gun 208, the U-shaped clip 110 has two opposing portions 910, 912 thereon with a rounded outer surface 914, 916 separating and defining an clip entrance width 918 less than a diameter 920 of the nozzle receiving channel 908. The two opposing portions 910 interpose the nozzle receiving channel 908 and the at least two opposing terminal ends 902, 904 of the flexible U-shaped clip 110. In one embodiment, the clip entrance width 918 and the diameter 920 of the nozzle receiving channel 908 are approximately 1.2 inches and 1.5 inches, respectively. Said dimensions may vary, however, depending on the nozzle diameter of the soda gun 208. In one embodiment, the two opposing portions of the flexible U-shaped clip are disposed in a symmetrically arcuate configuration with respect to one another, but in other embodiments said configuration may vary.

The rounded outer surface 914, 916 of the U-shaped clip 110 facilitates in enabling the nozzle of the soda gun 208 to quickly and safely move the soda gun 208 in and out of the U-shaped clip 110. In one embodiment, the flexible U-shaped clip 110, namely the nozzle receiving channel 808, is disposed proximal to the second end 402 of the holster housing 104, i.e., at or within 5-10% of the housing length 1000 of the second end 402, to safely displace the soda gun 208 away from inadvertent user contact when stored in the holster assembly 100. Additionally, the nozzle receiving channel 808 is also preferably of an annular shape to provide continuous support and contact with the nozzle of the soda gun 208. In some embodiments, the U-shaped clip 110 may also have a locking member coupled thereto that is operably configured to selectively removably lock into place with respect to the clip 110 to lock the soda gun 208 when retained by the clip 110. Said another way, the locking member will be able to prevent bi-directional longitudinal movement of the soda gun 208 when retained by the clip 110.

With reference to FIGS. 1-2, FIGS. 6-7, FIGS. 9-10, and FIGS. 14-15, the holster assembly 100 also includes a lower guide member 114 and/or an upper guide member 600 formed thereon to facilitate in the attachment of the U-shaped clip 110 with the soda gun 208. More specifically, the lower guide member 114 may be disposed proximal and coupled to the first end 400 of the holster housing 104 and may have an upper concave surface 116 at least partially facing, and defining, the nozzle translation channel 700. The upper concave surface 116 of the lower guide member 114 may also be disposed in an upwardly sloped configuration toward the first end 400 of the holster housing 104 to guide the nozzle end 412 of the soda gun 208 out of or into the housing 104 without damaging the same. The lower guide member 114 also facilitates in directing liquid to the basin 200. The upper guide member 600 may disposed proximal and coupled to the lower face 106 of the mounting bracket 102 and may have a side guide member 702 and a top guide member 704 both partially defining the soda gun storage zone 700. In one embodiment, the side guide member 702 and the top guide member 704 are disposed at a substantially orthogonal configuration with respect to one another spanning a portion of the housing length 1000. Additionally, the top guide member 704 may include a plurality of cascading wall portions extending downwardly away from the lower face 106 of the mounting bracket 102 and into the soda gun storage zone 700 and in a direction toward the flexible U-shaped clip 110 to effectively and safely guide the soda gun 208 into and away from the U-shaped clip 110 for retention and removal, respectively. The top guide member 704 serves not only to guide the soda gun 208, but may also provide an upper support member preventing the soda gun 208 from being inadvertently removed from the holster assembly 100 when subjected to a downward or upward force (or "moment") on the handle 210 of the soda gun 208. Said differently, the internal structural configuration and openings of the assembly 100 may enable the user to only remove the soda gun 208 in a substantially longitudinal direction, thereby minimizing instances of inadvertent removal of the soda gun 208.

With reference to FIGS. 1-6, FIG. 9, and FIGS. 12-13, the holster assembly 100 also beneficially includes a liquid capturing basin 200 for capturing and/or directing liquid emitted from the nozzle opening 414 of the soda gun 208. The liquid capturing basin 200 includes a sidewall 202 with an upper edge 502 directly coupled to the lower end 900 of the holster housing 104, a bottom wall 404 coupled to the sidewall 202 of the liquid capturing basin 200, and a spout 204 with a spout opening 300. The sidewall 202 of the liquid capturing basin 200 surrounds and defines, with the bottom wall 404 of the liquid capturing basin 200, a liquid capturing cavity 406. In one embodiment, the spout opening 300 is directed toward another container where errant or emitted liquid can be housed, directed to a hose for transporting said liquid, and/or disposed by the user. The outer surface of the spout 204 is also diametrically tapered toward the end of the spout 204 to effectively and beneficially receive varied hose sizes from ¼" to ⅜". In other embodiments, a hose or other conduit may attach to the spout 204 to direct errant or emitted liquid to another location.

Figure 4:
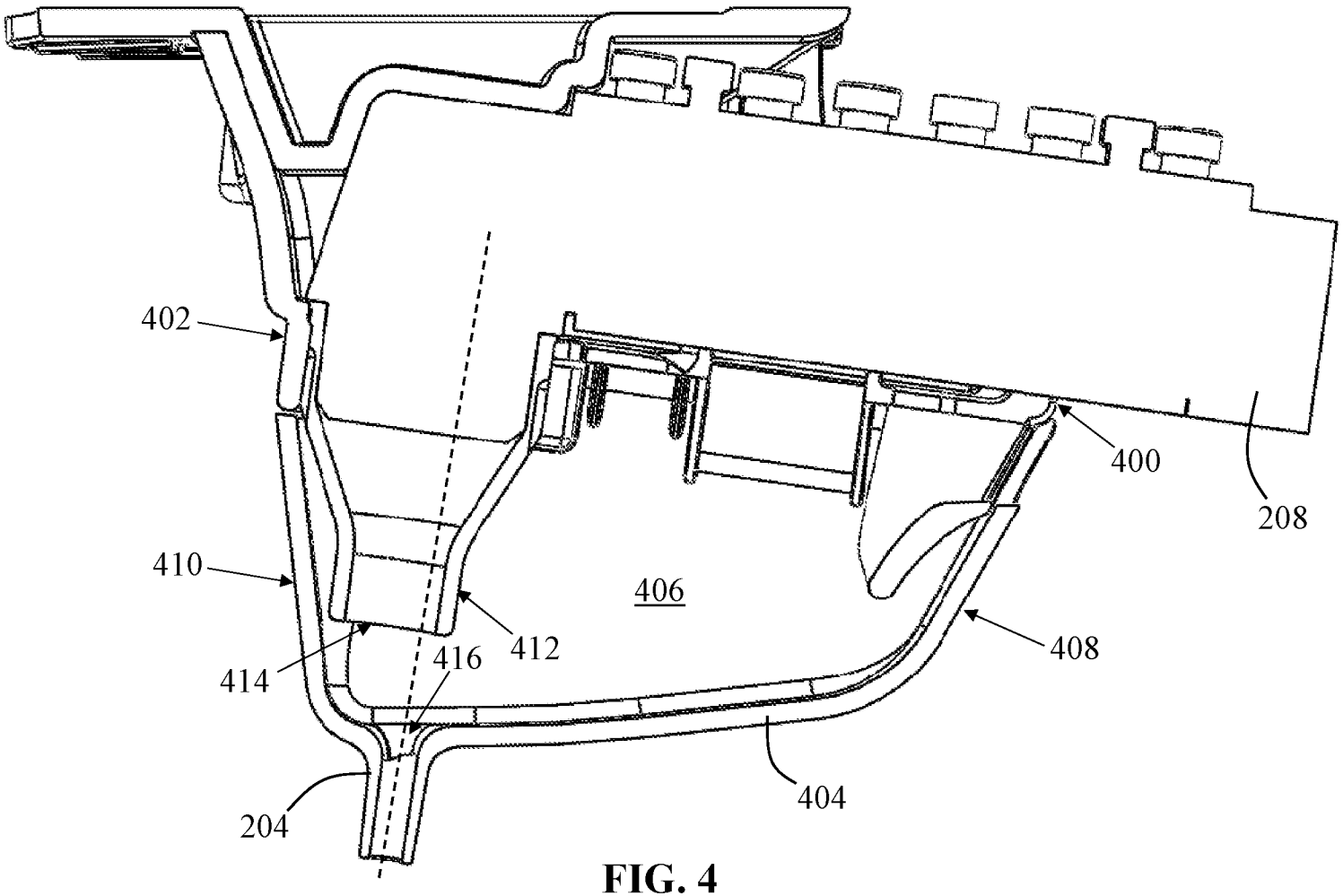
FIG. 4 is a cross-sectional view of the soda gun holster assembly in accordance with one embodiment of the present invention.

In one embodiment, the nozzle receiving channel 908 of the U-shaped clip 110 is disposed in an overlapping configuration with respect to the spout opening 300 to ensure the nozzle opening 414 is directly above the spout opening 416 defined by the inner surface of the bottom wall 404. The liquid capturing basin 200 may also include a first end 408 and a second end 410, opposing the first end 408 of the liquid capturing basin 200, wherein the spout opening 300 is disposed proximal to the second end 410 of the liquid capturing basin 200 and the bottom wall 404 of the liquid capturing basin 200 is disposed in a downwardly sloped configuration in a direction away from the first end 408 of the liquid capturing basin 200 and toward the first end 408 of the liquid capturing basin 200. The internal sidewalls of the basin 200 may also be sloped toward the spout 204. As such, any pooling liquid will be effectively directed toward the spout 204. As best shown in FIG. 4, the basin 200 may also span the length 1000 of the housing 104, thereby minimizing the risk of becoming dislodged upon contact with the holster before it's clipped into position (as is common in the art). This is also used to contain unintentional discharge due to the user accidentally depressing a button on the soda gun. The basin 200 also includes intentional air gaps to allow a vacuum break for open draining.

In one embodiment, the liquid capturing basin 200 is formed as one piece with the housing 104. In other embodiments, the liquid capturing basin 200 is selectively removably couplable to the housing 104. To effectuate the same, the liquid capturing basin 200 may include at least two flexible locking tab members 602*a-b* each coupled to the liquid capturing basin 200 and extending outwardly away from and passed the upper edge 502 of the sidewall 202 of the liquid capturing basin 200. As such, the liquid capturing basin 200 may be selectively removably coupled to the holster housing 104 through the least two flexible locking tab members 602*a-b*. This connection enables quick and effective coupling and removal of the liquid capturing basin 200 for disposal of any liquid housed within the liquid capturing basin 200. More specifically, the flexible locking tab members 602*a-b* are shaped and sized to be received within corresponding apertures defined on the housing 104, wherein the flexible locking tab members 602*a-b* also have one or more flanges thereon that are operably configured to prevent upward and downward movement of the basin 200 when coupled to the housing 104. The liquid capturing basin 200 may also include one or more alignment tabs 1200*a-n* operably configured to ensure the liquid capturing basin 200 is effectively and quickly coupled with the housing 104.

Although a specific order of carrying out a process of making and using the soda gun holster assembly has been described, the order of executing steps may be changed relative to the order shown in certain embodiments. Also, two or more steps described or shown in succession may be executed concurrently or with partial concurrence in some embodiments. Certain steps may also be omitted for the sake of brevity. In some embodiments, some or all of the process steps can be combined into a single process.

Additionally, various modifications and additions can be made to the exemplary embodiments discussed without departing from the scope of the present disclosure for the soda gun holster assembly. For example, while the embodiments described above refer to particular features, the scope of this disclosure also includes embodiments having different combinations of features and embodiments that do not include all of the above described features.

What is claimed is:

1. A soda gun holster assembly comprising:

a holster mounting bracket with an upper face and a lower face opposing the upper face of the mounting bracket; and a holster housing coupled to the lower face of the holster mounting bracket and having:

a sidewall surrounding and defining a soda gun storage zone and having at least two opposing side terminal ends defining a first end of the holster housing and a housing opening spatially coupled to the soda gun storage zone, wherein the first end of the holster housing opposes a second end of the holster housing and the holster housing defines a housing length separating the first and second ends of the holster housing;

an upper end and a lower end, the holster housing defining a nozzle translation channel disposed along the housing length and at the lower end of the holster housing; and a flexible U-shaped clip operably configured to flex laterally and is coupled to the sidewall and having a continuous sidewall with at least two opposing terminal ends unattached from the holster housing and defining a single clip opening spatially coupled to the nozzle translation channel and a nozzle receiving channel defined by an inner surface of the continuous sidewall, the U-shaped clip having two opposing portions thereon with a rounded outer surface separating and defining a clip entrance width less than a diameter of the nozzle receiving channel, wherein the opposing portions defining the clip entrance width interposes the nozzle receiving channel and the at least two opposing terminal ends of the flexible U-shaped clip, and wherein the upper face of the holster mounting bracket is substantially planar, and the upper end of the holster housing is configured to be removably coupled to the lower face of the holster mounting bracket.

2. The soda gun holster assembly according to claim 1, wherein:

the holster mounting bracket is selectively removably couplable to the holster housing with at least one fastener.

3. The soda gun holster assembly according to claim 1, wherein:

the nozzle receiving channel is disposed proximal to the second end of the holster housing and is of an annular shape.

4. The soda gun holster assembly according to claim 1, further comprising:

a lower guide member disposed proximal and coupled to the first end of the holster housing, the lower guide member having an upper concave surface at least partially facing the nozzle translation channel.

5. The soda gun holster assembly according to claim 4, wherein:

the upper concave surface of the lower guide member is disposed in an upwardly sloped configuration toward the first end of the holster housing.

6. The soda gun holster assembly according to claim 1, further comprising:

an upper guide member disposed proximal and coupled to the lower face of the mounting bracket, the upper guide member having a side guide member and a top guide member both partially defining the soda gun storage zone, the top guide member of a plurality of cascading wall portions extending downwardly away from the lower face of the mounting bracket and into the soda gun storage zone and in a direction toward the flexible U-shaped clip.

7. The soda gun holster assembly according to claim 1, further comprising:

a liquid capturing basin having a sidewall with an upper edge directly coupled to the lower end of the holster housing, a bottom wall coupled to the sidewall of the liquid capturing basin, and a spout with a spout opening, the sidewall of the liquid capturing basin surrounding and defining, with the bottom wall of the liquid capturing basin, a liquid capturing cavity.

8. The soda gun holster assembly according to claim 7, wherein:

the nozzle receiving channel of the U-shaped clip is disposed in an overlapping configuration with respect to the spout opening.

9. The soda gun holster assembly according to claim 8, wherein the liquid capturing basin further comprises:

a first end and a second end opposing the first end of the liquid capturing basin, wherein the spout opening is disposed proximal to the second end of the liquid capturing basin and the bottom wall of the liquid capturing basin is disposed in a downwardly sloped configuration in a direction away from the first end of the liquid capturing basin and toward the first end of the liquid capturing basin.

10. The soda gun holster assembly according to claim 8, wherein the liquid capturing basin further comprises:

at least two flexible locking tab members each coupled to the liquid capturing basin and extending outwardly away from and passed the upper edge of the sidewall of the liquid capturing basin, the liquid capturing basin selectively removably coupled to the holster housing through the least two flexible locking tab members.

11. The soda gun holster assembly according to claim 1, wherein:

the lower face of the holster mounting bracket is disposed in an overlapping configuration with the nozzle receiving channel defined by an inner surface of the continuous sidewall.

12. A soda gun holster assembly comprising:

a holster housing with a mounting bracket operably configured to selectively couple with a countertop, the holster housing having:

a sidewall surrounding and defining a soda gun storage zone and having at least two opposing side terminal ends defining a first end of the holster housing and a housing opening spatially coupled to the soda gun storage zone, wherein the first end of the holster housing opposes a second end of the holster housing and the holster housing defines a housing length separating the first and second ends of the holster housing;

an upper end and a lower end, the holster housing defining a nozzle translation channel disposed along the housing length and at the lower end of the holster housing; and a flexible U-shaped clip operably configured to flex laterally and is coupled to the sidewall, disposed proximal to the second end of the holster housing, and having at least two opposing terminal ends unattached from the holster housing and defining a single clip opening spatially coupled to the nozzle translation channel and a nozzle receiving channel defined by an inner surface of the flexible U-shaped clip, the U-shaped clip having two opposing portions thereon with a rounded outer surface separating and defining a clip entrance width less than a diameter of the nozzle receiving channel, wherein the opposing portions defining the clip entrance width interposes the nozzle receiving channel and the at least two opposing terminal ends of the flexible U-shaped clip, and wherein the mounting bracket has an upper face which is substantially planar and a lower face opposing the upper face, and the upper end of the holster housing is configured to be removably coupled to the lower face of the mounting bracket.

13. The soda gun holster assembly according to claim 12, wherein: the lower face is directly coupled to the upper end of the holster housing.

14. The soda gun holster assembly according to claim 13, wherein:

the mounting bracket is selectively removably couplable to the holster housing with at least one fastener.

15. The soda gun holster assembly according to claim 12, wherein:

the two opposing portions of the flexible U-shaped clip are disposed in a symmetrically arcuate configuration with respect to one another.

16. The soda gun holster assembly according to claim 12, wherein:

the nozzle receiving channel is disposed proximal to the second end of the holster housing and is of an annular shape.

17. The soda gun holster assembly according to claim 12, further comprising:

a lower guide member disposed proximal and coupled to the first end of the holster housing, the lower guide member having an upper concave surface at least partially facing the nozzle translation channel and disposed in an upwardly sloped configuration toward the first end of the bolster housing.

18. The soda gun holster assembly according to claim 12, further comprising:

an upper guide member disposed proximal and coupled to the lower face of the mounting bracket, the upper guide member having a side guide member and a top guide member both partially defining the soda gun storage zone, the top guide member of a plurality of cascading wall portions extending downwardly away from the lower face of the mounting bracket and into the soda gun storage zone and in a direction toward the flexible U-shaped clip.

19. The soda gun holster assembly according to claim 12, further comprising:

a liquid capturing basin having a sidewall with an upper edge directly coupled to the lower end of the holster housing, a bottom wall coupled to the sidewall of the liquid capturing basin, and a spout with a spout opening, the sidewall of the liquid capturing basin surrounding and defining, with the bottom wall of the liquid capturing basin, a liquid capturing cavity.

20. The soda gun holster assembly according to claim 19, wherein:

the nozzle receiving channel of the U-shaped clip is disposed in an overlapping configuration with respect to the spout opening.

21. The soda gun holster assembly according to claim 19, wherein the liquid capturing basin further comprises:

a first end and a second end opposing the first end of the liquid capturing basin, wherein the spout opening is disposed proximal to the second end of the liquid capturing basin and the bottom wall of the liquid capturing basin is disposed in a downwardly sloped configuration in a direction away from the first end of the liquid capturing basin and toward the first end of the liquid capturing basin.

22. A soda gun holster assembly comprising:

a holster housing with a mounting bracket operably configured to selectively couple with a countertop, the holster housing having:

a sidewall surrounding and defining a soda gun storage zone and having at least two opposing side terminal ends defining a first end of the holster housing and a housing opening spatially coupled to the soda gun storage zone, wherein the first end of the holster housing opposes a second end of the holster housing and the holster housing defines a housing length separating the first and second ends of the holster housing;

an upper end and a lower end, the bolster housing defining a nozzle translation channel disposed along the housing length and at the lower end of the holster housing; and a flexible U-shaped clip coupled to the sidewall, disposed proximal to the second end of the holster housing, and having at least two opposing terminal ends defining a single clip opening spatially coupled to the nozzle translation channel and a nozzle receiving channel defined by an inner surface of the flexible U-shaped clip, the U-shaped clip having two opposing portions thereon with a rounded outer surface separating and defining a clip entrance width less than a diameter of the nozzle receiving channel, wherein the opposing portions defining the clip entrance width interposes the nozzle receiving channel and the at least two opposing terminal ends of the flexible U-shaped clip; and a lower guide member disposed proximal and coupled to the first end of the holster housing, the lower guide member having an upper concave surface at least partially facing the nozzle translation channel and disposed in an upwardly sloped configuration toward the first end of the holster housing.

23. A soda gun holster assembly comprising:

a holster housing with a mounting bracket operably configured to selectively couple with a countertop, the holster housing having:

a sidewall surrounding and defining a soda gun storage zone and having at least two opposing side terminal ends defining a first end of the holster housing and a housing opening spatially coupled to the soda gun storage zone, wherein the first end of the holster housing opposes a second end of the holster housing and the holster housing defines a housing length separating the first and second ends of the holster housing;

an upper end and a lower end, the holster housing defining a nozzle translation channel disposed along the housing length and at the lower end of the holster housing; and a flexible U-shaped clip coupled to the sidewall, disposed proximal to the second end of the holster housing, and having at least two opposing terminal ends defining a single clip opening spatially coupled to the nozzle translation channel and a nozzle receiving channel defined by an inner surface of the flexible U-shaped clip, the U-shaped clip having two opposing portions thereon with a rounded outer surface separating and defining a clip entrance width less than a diameter of the nozzle receiving channel, wherein the opposing portions defining the clip entrance width interposes the nozzle receiving channel and the at least two opposing terminal ends of the flexible U-shaped clip; and an upper guide member disposed proximal and coupled to the lower face of the mounting bracket, the upper guide member having a side guide member and a top guide member both partially defining the soda gun storage zone, the top guide member of a plurality of cascading wall portions extending downwardly away from the lower face of the mounting bracket and into the soda gun storage zone and in a direction toward the flexible U-shaped clip.

24. A soda gun holster assembly comprising:

a holster housing with a mounting bracket operably configured to selectively couple with a countertop, the holster housing having:

a sidewall surrounding and defining a soda gun storage zone and having at least two opposing side terminal ends defining a first end of the holster housing and a housing opening spatially coupled to the soda gun storage zone, wherein the first end of the holster housing opposes a second end of the holster housing and the holster housing defines a housing length separating the first and second ends of the holster housing;

an upper end and a lower end, the holster housing defining a nozzle translation channel disposed along the housing length and at the lower end of the holster housing; and a flexible U-shaped clip coupled to the sidewall, disposed proximal to the second end of the holster housing, and having at least two opposing terminal ends defining a single clip opening spatially coupled to the nozzle translation channel and a nozzle receiving channel defined by an inner surface of the flexible U-shaped clip, the U-shaped clip having two opposing portions thereon with a rounded outer surface separating and defining a clip entrance width less than a diameter of the nozzle receiving channel, wherein the opposing portions defining the clip entrance width interposes the nozzle receiving channel and the at least two opposing terminal ends of the flexible U-shaped clip; and a liquid capturing basin having a sidewall with an upper edge directly coupled to the lower end of the holster housing, a bottom wall coupled to the sidewall of the liquid capturing basin, and a spout with a spout opening, the sidewall of the liquid capturing basin surrounding and defining, with the bottom wall of the liquid capturing basin, a liquid capturing cavity.

* * * * *